US008191917B2

(12) United States Patent
Wang et al.

(10) Patent No.: US 8,191,917 B2
(45) Date of Patent: Jun. 5, 2012

(54) SNOWBOARD BINDING

(75) Inventors: Chi-Tsang Wang, Taichung (TW); Fan-Yi Wang, Taichung (TW)

(73) Assignee: Charlton Co., Ltd., Taichung (TW)

( * ) Notice: Subject to any disclaimer, the term of this patent is extended or adjusted under 35 U.S.C. 154(b) by 435 days.

(21) Appl. No.: 12/556,521

(22) Filed: Sep. 9, 2009

(65) Prior Publication Data

US 2011/0057419 A1 Mar. 10, 2011

(51) Int. Cl.
*A63C 9/00* (2006.01)
*A63C 9/14* (2006.01)
*A63C 1/04* (2006.01)

(52) U.S. Cl. ..... 280/611; 280/11.3; 280/11.31; 280/618; 280/619; 280/623; 280/626; 280/633; 280/14.24

(58) Field of Classification Search ..... 280/11.31, 280/11.3, 611, 613, 618, 619, 620, 623, 626, 280/627, 628, 632, 633, 14.22, 14.24
See application file for complete search history.

(56) References Cited

U.S. PATENT DOCUMENTS 5,692,765 A * 12/1997 Laughlin ..... 280/619
5,769,446 A * 6/1998 Borsoi ..... 280/623
5,918,897 A 7/1999 Hansen et al.
5,997,027 A * 12/1999 Jungkind ..... 280/617
6,003,893 A * 12/1999 Hansen ..... 280/624
6,007,077 A * 12/1999 Moe ..... 280/14.22
6,065,770 A * 5/2000 Hansen et al. ..... 280/617
6,293,577 B1 * 9/2001 Shields ..... 280/617
6,722,688 B2 * 4/2004 Poscich ..... 280/618
6,886,849 B2 * 5/2005 Mandon ..... 280/618
7,147,233 B2 12/2006 Edmond
7,207,592 B2 * 4/2007 Pascal et al. ..... 280/623
7,246,811 B2 * 7/2007 Martin ..... 280/611
7,520,526 B2 * 4/2009 Muscatelli ..... 280/617
7,618,054 B2 * 11/2009 Cunningham et al. ..... 280/617
8,016,315 B2 * 9/2011 Neiley et al. ..... 280/611
2007/0290463 A1 * 12/2007 White ..... 280/14.24
2010/0253045 A1 * 10/2010 Fumagalli ..... 280/619

* cited by examiner

*Primary Examiner* — John R Olszewski
(74) *Attorney, Agent, or Firm* — Egbert Law Offices PLLC

(57) ABSTRACT

The present invention provides a snowboard binding, including a mount, rear plate, top plate assembly base, rotary top pressboard, trigger support and coupling plate. The coupling plate, the mating frame of the rotary top pressboard, the mating ends of the trigger support and the top plate assembly base are coupled together to form a four-bar mechanism. The pressing state of the rotary top pressboard can be positioned directly by the perpendicular trigger support, and the rotary top pressboard can realize an expanded opening state over 90°. Thus, the snowboard boot can be slipped directly into the snowboard binding, enabling more convenient locating and release of the snowboard binding with better efficiency and applicability.

11 Claims, 10 Drawing Sheets

SNOWBOARD BINDING

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to fittings for a snowboard, and more particularly to an innovative fitting with a binding for a snowboard boot.

2. Description of Related Art Including Information Disclosed Under 37 CFR 1.97 and 37 CFR 1.98

The snowboard is structurally set in such a way that a binding must be assembled at the top for slipping and fixation of the snowboard boot.

As for a conventional snowboard binding, it is time-consuming to slip and fix or remove the snowboard boot, making considerably awkward for the users. Therefore, continuous efforts have been made in the industry to provide and innovative fixing mechanism to overcome the shortcomings of the conventional snowboard binding.

The following are some examples of conventional snowboard bindings, having a particular structure and the following shortcomings.

A snowboard binding is disclosed in U.S. Pat. No. 6,003,893, wherein the top pressboard and the rear plate are linked by a rope, and a movable bending frame is set on the bottom plate of the snowboard binding. When the snowboard boot is slipped into the binding and treaded onto the movable curved frame, the rope can be pulled to drive the pressboard and rear plate for swinging correspondingly and tightening of the snowboard boot. However, it is found during actual application that the rope is vulnerable to abrasion, cracking and damage, resulting in a shorter service life. Moreover, the snowboard boot cannot be slipped easily due to the very limited maximum opening angle formed between the pressboard and rear plate.

A snowboard binding is also disclosed in U.S. Pat. No. 7,207,592 B2, wherein the rear plate can swing obliquely, allowing to control the maximum and minimum opening angle for the snowboard boot. The front pressure plate is fixedly profiled, so the maximum opening angle for the snowboard boot is still extremely limited, leading to inconvenient slipping of the snowboard boot.

Snowboard bindings are also disclosed in U.S. Pat. No. 7,246,811 B2, U.S. Pat. No. 7,147,233 B2, U.S. Pat. No. 5,918,897, wherein the maximum opening angle for each snowboard boot is still extremely limited despite of the adjustable design of the front pressboard or the rear plate. In such cases, the users have to slip their boots into the binding from an oblique path. Yet, snowboarders and skiiers generally put on heavy clothes and snowboard boots, making them move clumsily, even without mentioning shifting the snowboard binding fixed on the prolonged or expanded snowboard. Hence, the relevant industries have to make breakthrough innovation to simplify the slipping and disengagement of snowboard boot and to operate the snowboard binding more easily and flexibly.

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

Based on the unique present invention, the coupling plate, the mating frame of the rotary top pressboard, the mating ends of the trigger support and the top plate assembly base are coupled together to form a four-bar mechanism. The pressing state of the rotary top pressboard can be positioned directly by the perpendicular trigger support, and the rotary top pressboard can realize an expanded opening state over 90°. Thus, the snowboard boot can be slipped directly into the snowboard binding, enabling more convenient locating and release of the snowboard binding with better efficiency and applicability.

Based on the top plate assembly base of the present invention, the top plate assembly base is assembled onto the lateral flange of the mount in such a manner that it can be lifted or regulated flexibly. It is possible to meet the diversified demands of different human groups with various ages or body sizes.

Based on the structure of the snowboard binding of the present invention, there is an auxiliary locator of the top plate. The pressing state of the snowboard boot press surface of the rotary top pressboard can be further positioned supplementary.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
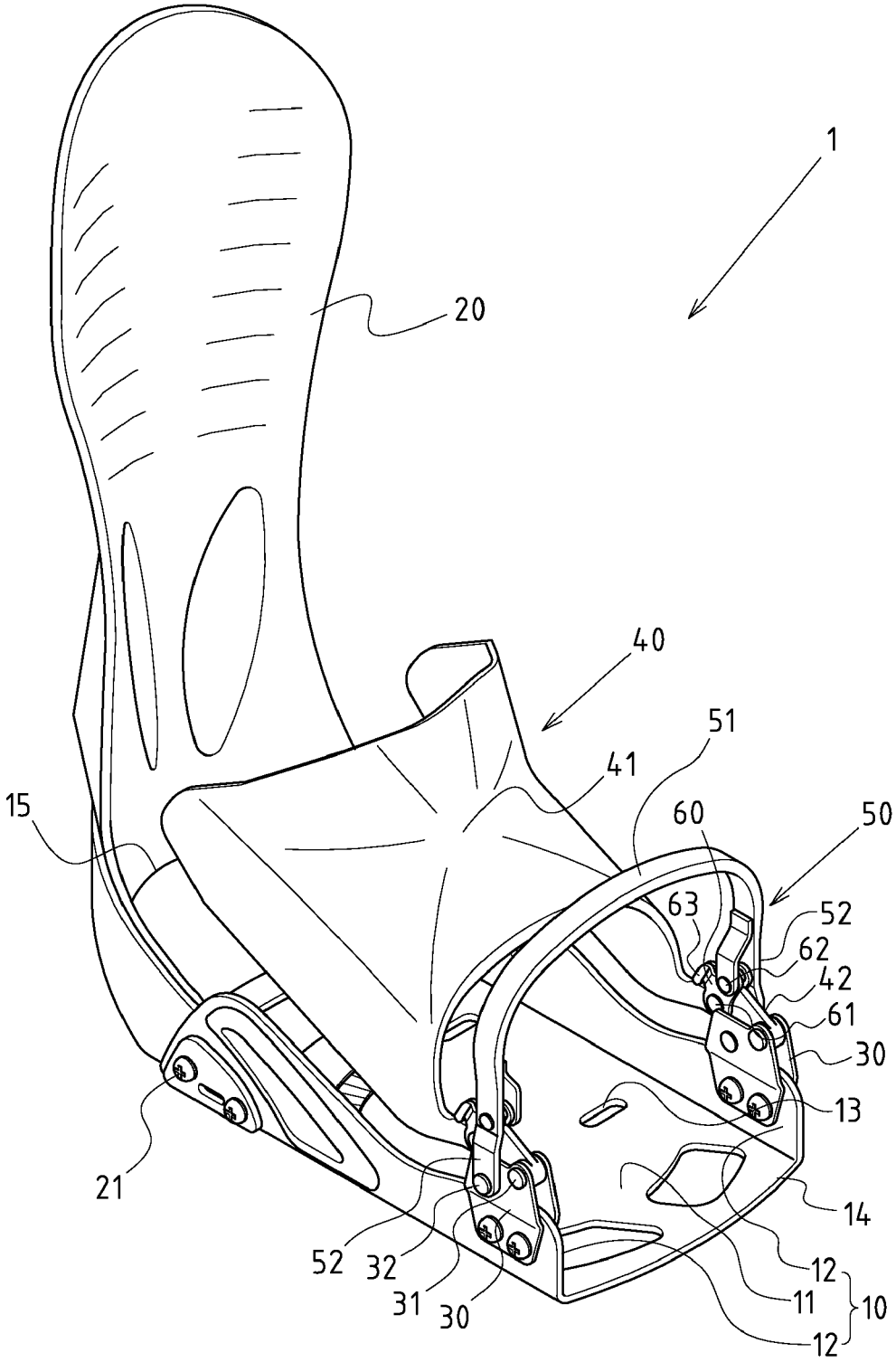
FIG. 1 shows an assembled perspective view of the preferred embodiment of the present invention.
Figure 2:
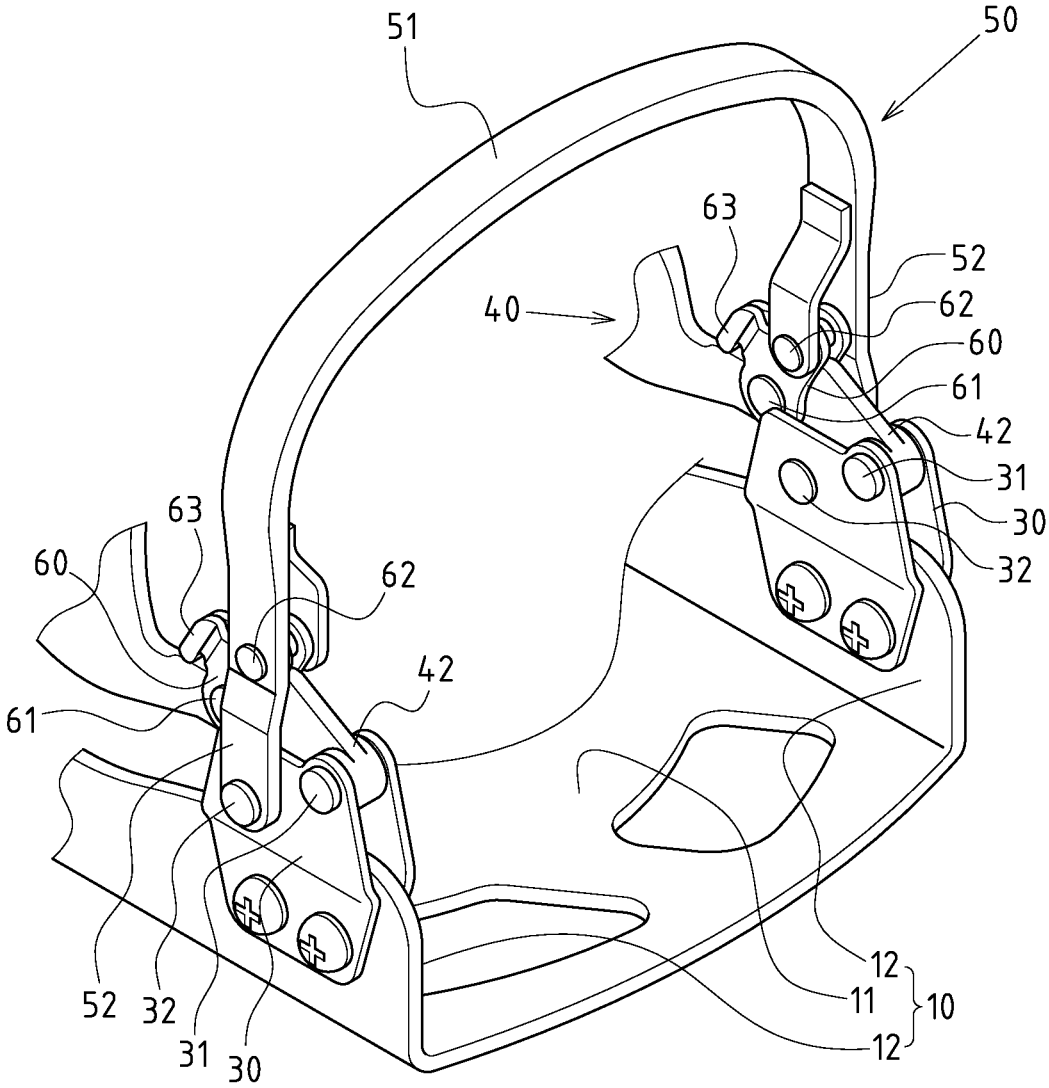
FIG. 2 shows a partially enlarged perspective view of FIG. 1.
Figure 3:
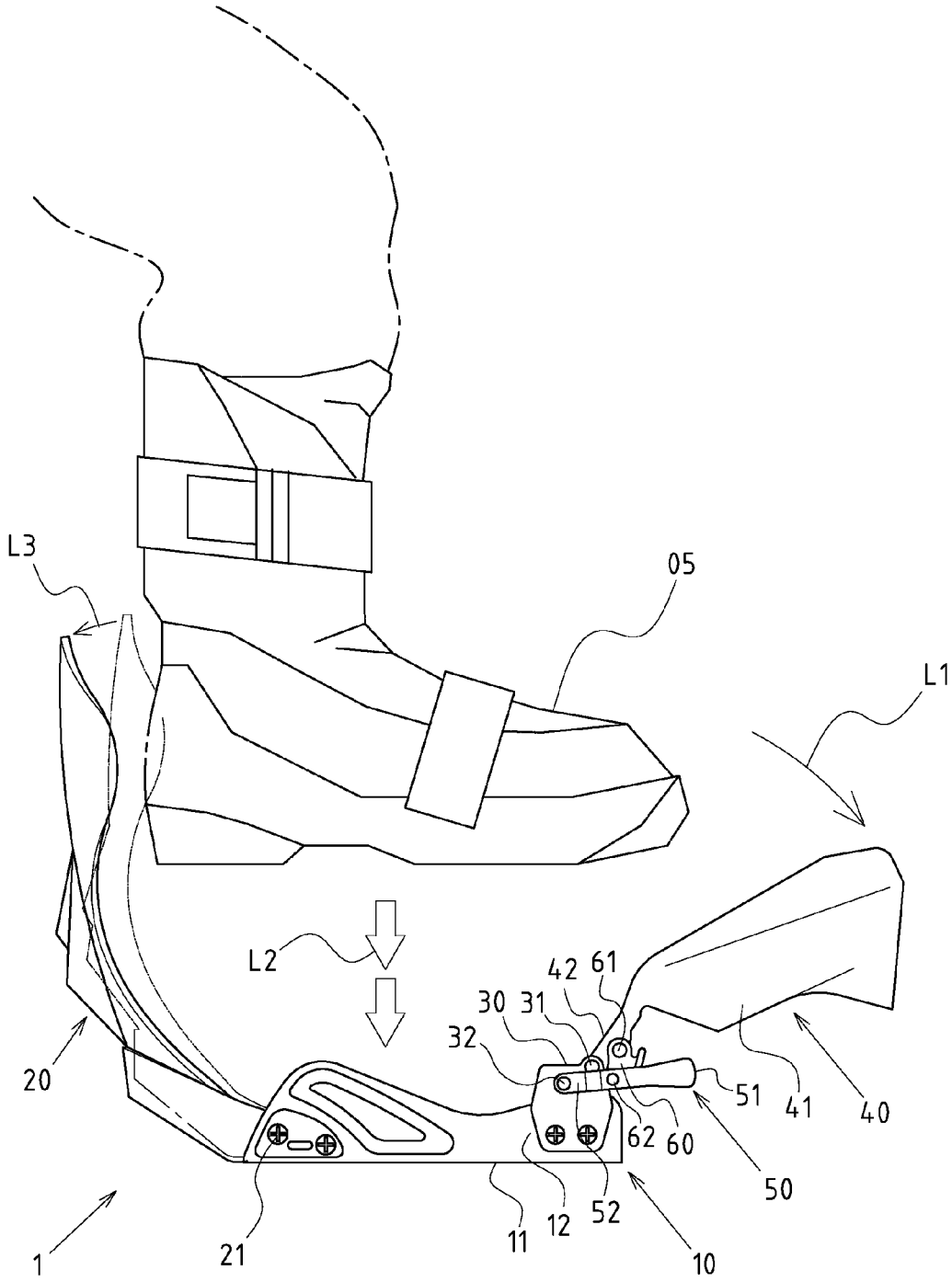
FIG. 3 shows a side elevation view of a first status of the preferred embodiment of the present invention.

FIGS. 1-3 depict preferred embodiments of a snowboard binding of the present invention. The embodiments are provided for only explanatory objectives with respect to their patent claims.

The snowboard binding 1 of the snowboard comprises a mount 10, containing a bottom plate 11 and two lateral flanges 12 protruding vertically at both sides of the bottom plate 11. A snowboard locating portion 13 is set centrally onto the bottom plate 11. A front opening 14 is formed in front of the bottom plate 11, and a rear opening 15 formed behind the bottom plate 11.

There is a rear plate 20 extending vertically and having a bottom. The bottom of the rear plate 20 is pivoted onto the rear side of two lateral flanges 12 of the mount 10 via a pivot bolt 21, so that the top of the rear plate 20 can be adjusted in a swinging state.

Two top plate assembly bases 30 are mounted correspondingly at a front of two lateral flanges 12 of the mount 10. A top plate joint 31 and a trigger support joint 32 are assembled transversely at intervals on the top plate assembly base 30. Moreover, the top plate joint 31 is located higher than the trigger support joint 32.

The invention also includes a rotary top pressboard 40, containing a snowboard boot press surface 41 and two mating frames 42 extending from both frontal sides of the snowboard boot press surface 41. These two mating frames 42 are separately pivoted onto the top plate joint 31 of two top plate assembly bases 30, so that the snowboard boot press surface 41 of the rotary top pressboard 40 may swing backwards into a pressing state, or swing forwards into an open state by taking the top plate joint 31 as a pivot.

A trigger support 50 is designed into a curved shape defining a trigger section 51 and two mating ends 52 at both ends of the trigger section 51. These two mating ends 52 are separately pivoted onto the trigger support joint 32 of two top plate assembly bases 30, so that the trigger section 51 can swing forwards or backwards by taking the trigger support joint 32 as a pivot.

Two coupling plates 60 are coupled between the mating frames 42 of the rotary top pressboard 40 and the mating ends 52 of the trigger support 50 in a pivoted state. The coupling plate 60 includes a first coupling end 61 and a second coupling end 62. The first coupling end 61 is pivoted onto the rotary top pressboard 40 close to the mating frame 42, and the second coupling end 62 is pivoted onto the trigger support 50 close to the mating ends 52. Furthermore, the coupling plate 60, the mating frame 42 of the rotary top pressboard 40, the mating ends 52 of the trigger support 50 and the top plate assembly base 30 are coupled together to form a four-bar mechanism.

Figure 5:
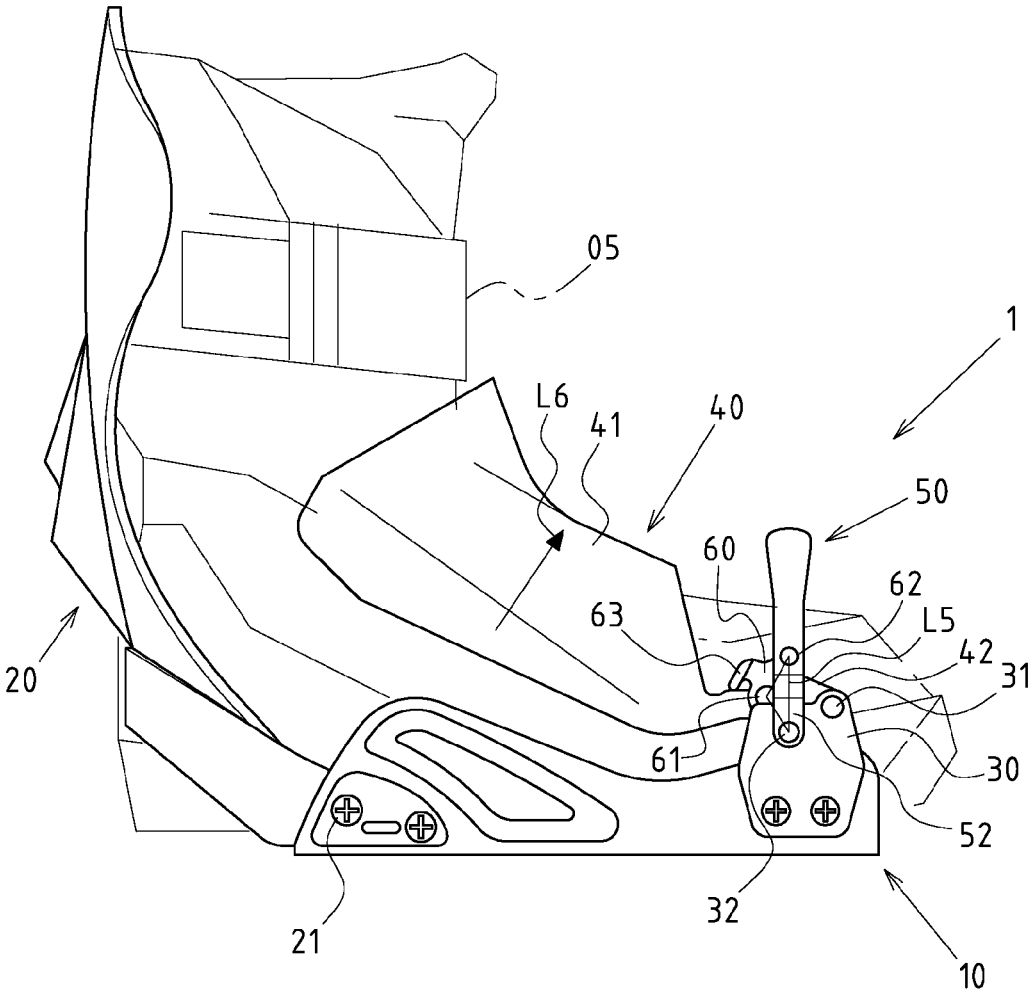
FIG. 5 shows a side elevation view of a third status of the preferred embodiment of the present invention.

Referring to FIGS. 2 and 5, a bossed claw 63 is placed laterally onto the coupling plate 60. The bossed claw 63 swings upwards vertically in the trigger section 51 of the trigger support 50. Moreover, the snowboard boot press surface 41 of the rotary top pressboard 40 is abutted onto the mating frame 42 of the rotary top pressboard 40 when it swings backwards into a pressing state.

Based on the aforementioned structures, the present invention is operated as follows:

Referring to FIG. 3, when the snowboard binding 1 is intended to be used for assembly of the snowboard boot 05, the user may apply a certain force to the trigger support 50 by hands or the other foot, and make it swing forwards to a transverse dead position, then pull the rotary top pressboard 40 by the coupling plate 60 for simultaneous forward swinging (indicated by arrow L1). The swinging angle of the snowboard boot press surface 41 of the rotary top pressboard 40 exceeds 90°, forming a super-wide-angle guide port of the snowboard boot. Thus, the snowboard boot 05 can be loaded by slipping vertically it (indicated by arrow L2). Moreover, when the snowboard boot 05 is loaded, a force can also be applied to pull back the rear plate 20 in a blocking position (indicated by arrow L3).

Figure 4:
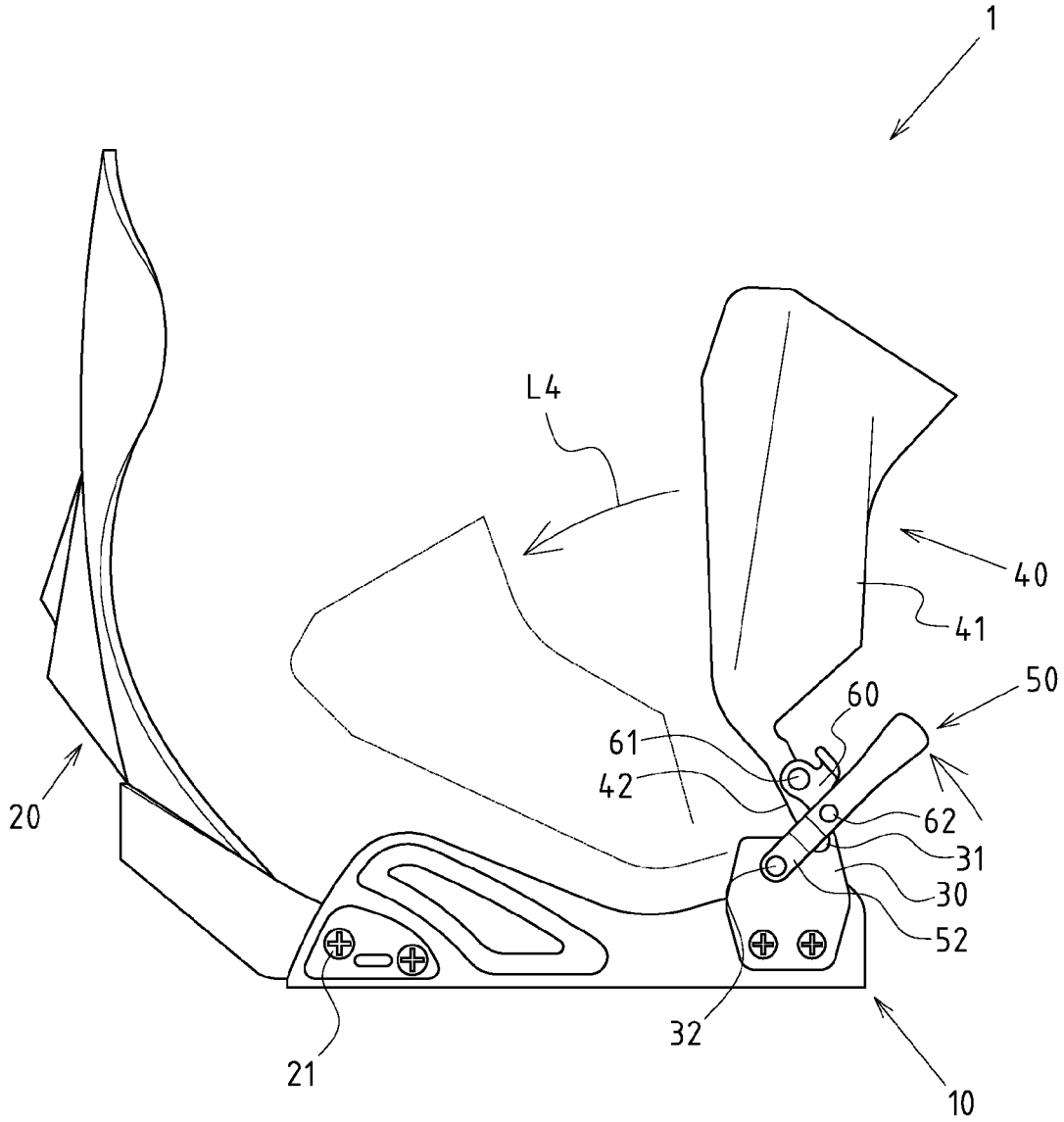
FIG. 4 shows another side elevation view of a second status of the preferred embodiment of the present invention.

After the snowboard boot 05 is fully slipped between the bottom plate 11 of the mount 10 and two lateral flanges 12, the user may apply a certain force to the trigger support 50 and make it swing backwards, then pull the rotary top pressboard 40 by the coupling plate 60 for simultaneous backward swinging (indicated by arrow L4 in FIG. 4). Next, when the trigger support 50 swings backwards rectangularly, the snowboard boot press surface 41 of the rotary top pressboard 40 is rightly pressed onto the top surface of the snowboard boot 05. In such a state, the first and second coupling ends 61, 62 of the coupling plate 60 and the trigger support joint 32 at a bottom of the mating ends 52 of the trigger support 50 form a triangular shape (indicated by arrow L5). In such a state, the upward action of the snowboard boot press surface 41 of the rotary top pressboard 40 (indicated by arrow L6) will be locked securely, and the rotary top pressboard 40 will thus be positioned since the coupling plate 60 mates obliquely with the trigger support 50 in a perpendicular position. The pushing direction of the coupling plate 60 is not on the swinging path of the trigger support 50, so the trigger support 50 is locked securely.

Referring to FIG. 1, the snowboard locating portion 13 on the bottom plate 11 of the mount 10 is comprised of a plurality of bolted locking holes arranged at intervals. Such a snowboard locating portion 13 is configured in such a manner that the snowboard binding 1 is mounted onto the snowboard in a fixed angle.

Figure 6:
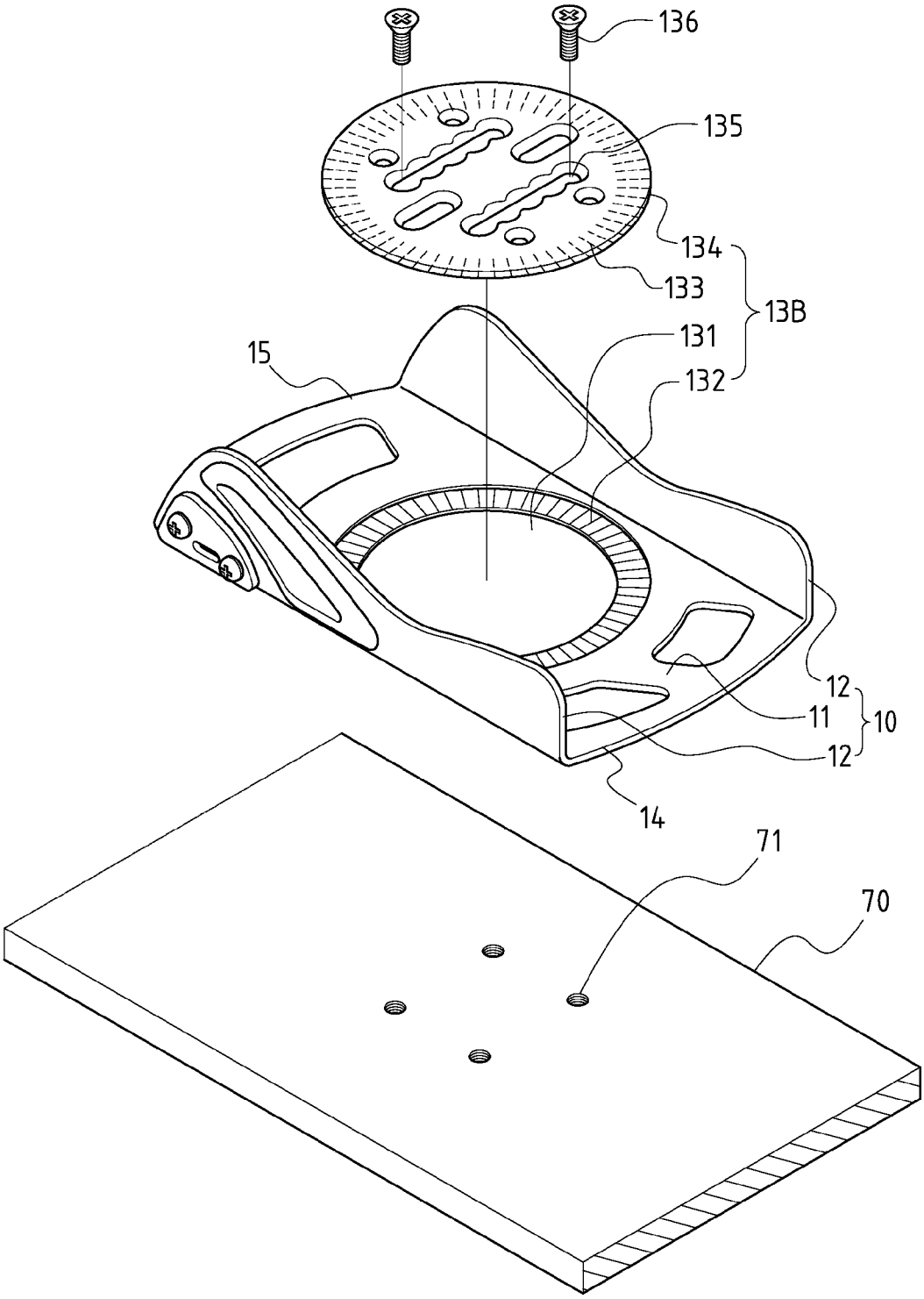
FIG. 6 shows an exploded perspective view of another preferred embodiment of the snowboard locating portion of the present invention.

Referring also to FIG. 6, the snowboard locating portion 13B comprises a round hole 131 on the bottom plate 11 of the mount 10, a toothed ring surface 132 surrounding the round hole 131, and around locating disc 134 with a toothed meshing surface 133 on the bottom. The round locating disc 134 is mated with the toothed ring surface 132 via the toothed meshing surface 133 in multiple angular positions. Moreover, a plurality of bolted locating holes 135 is arranged at intervals on the round locating disc 134, allowing the bolts 136 to be locked into the tapped holes 71 preset on the snowboard 70. This snowboard locating portion 13B is formed in such a way that, when the snowboard binding 1 is assembled onto the snowboard 70 but the bolt 136 is not screwed. The angle and orientation of the mount 10 can be fine-tuned, thereby adjusting the angle and orientation of the entire snowboard binding 1 on the snowboard 70.

Figure 8:
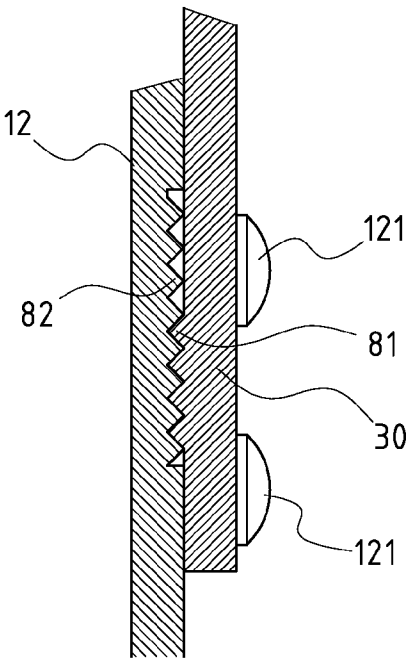
FIG. 8 shows a partial sectional view of the preferred embodiment of the present invention, the top plate assembly base being lifted and adjusted forwards and backwards.
Figure 7:
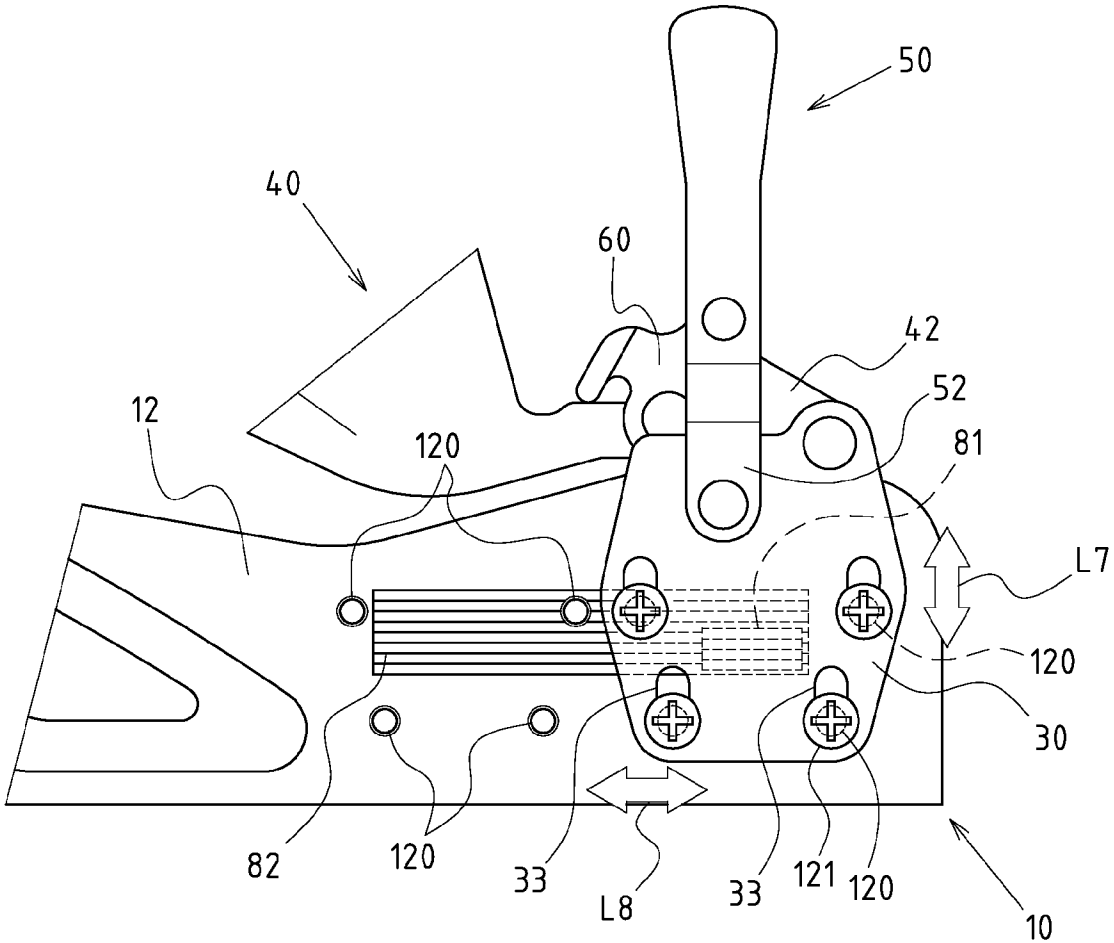
FIG. 7 shows a partial side elevation view of the preferred embodiment of the present invention, the top plate assembly base being lifted and adjusted forwards and backwards.

Referring to FIGS. 7 and 8, the top plate assembly base 30 is assembled onto the lateral flange of the mount 10 in such a manner that it can be lifted or regulated flexibly to meet the demands of different groups with various ages or body sizes. As for the preferred embodiment, the top plate assembly base 30 is provided with a plurality of long holes 33 arranged vertically. The lateral flange 12 of the mount 10 is provided with several groups of locating tapped holes 120 that are extended and arranged transversely in alignment with the long holes 33. So, a plurality of bolts 121 penetrates across the long holes 33 and then is locked into the locating tapped holes 120 enabling the positioning of the top plate assembly base 30. With the long holes 33, the top plate assembly base 30 can be lifted or regulated before the bolt 121 is screwed (indicated by arrow L7). Besides, the long holes 33 of the top plate assembly base 30 are locked correspondingly into the locating tapped holes 120 on the lateral flange 12 of the mount 10, enabling forward and backward adjustment of the top plate assembly base 30 (indicated by arrow L8). Moreover, locating tooth surfaces 81, 82 that can be meshed and extended transversely are arranged between the top plate assembly base 30 and the lateral flange 12 of the mounts 10, so the orientation of the top plate assembly base 30 can be fixed accurately during lifting or regulation.

Figure 9:
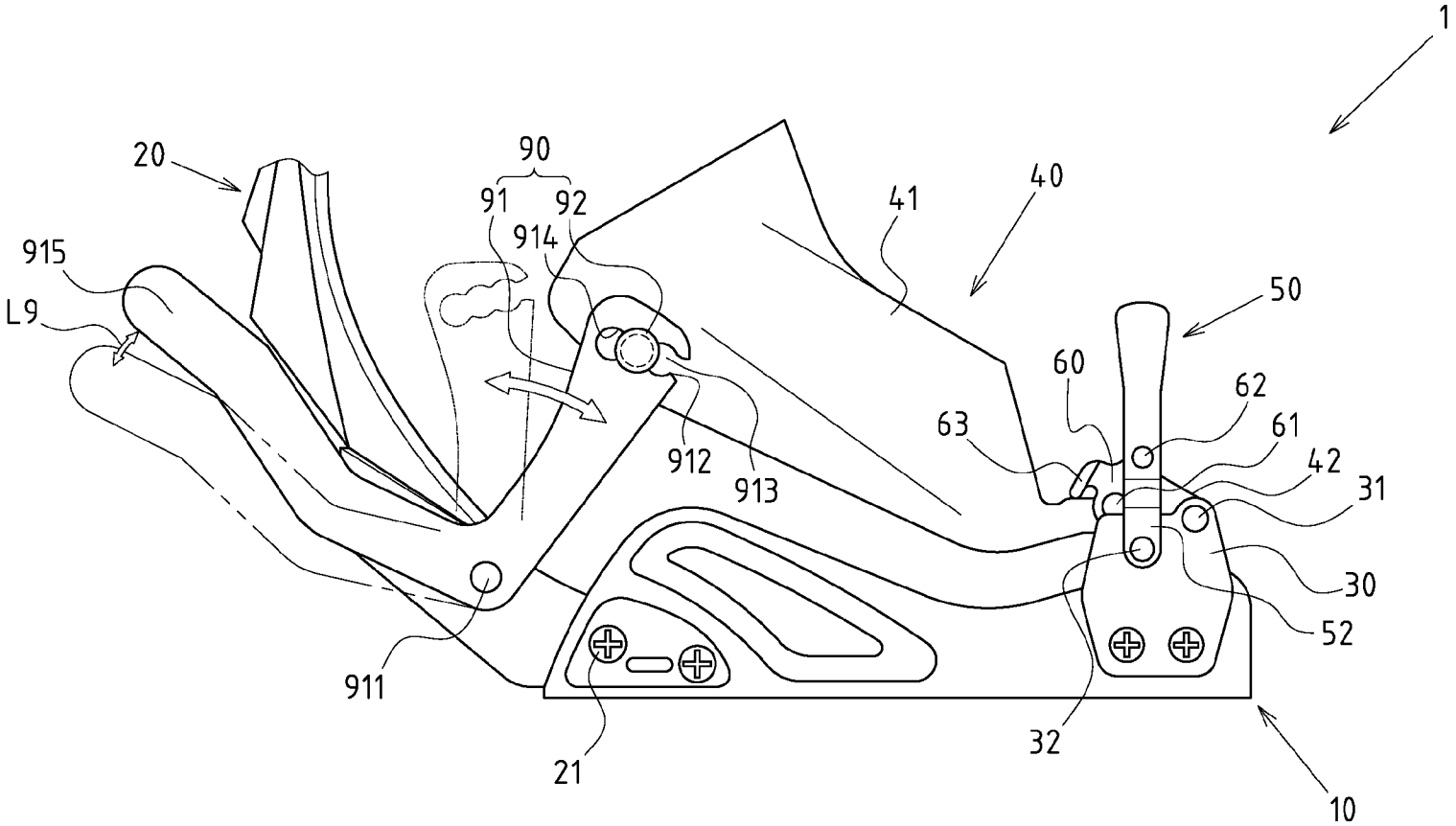
FIG. 9 shows a side elevation view of the present invention, the snowboard binding being additionally provided with an auxiliary locator of top plate.

Referring to FIG. 9, the snowboard binding 1 includes an auxiliary locator of top plate 90, which helps to strengthen the positioning of the snowboard boot press surface 41 set on the rotary top pressboard 40. The preferred embodiment of the auxiliary locator of top plate 90 includes a swiveling hooked sheet 91 and a locating column 92. The locating column 92 is protruded transversely at left and right sides of the snowboard boot press surface 41 on the rotary top pressboard 40. The bottom of the hooked sheet 91 is pivoted adjacent to the bottom of the rear plate 20 via a pivot bolt 911. A locating slot 913 with opening 912 is set at the top of the hooked sheet 91. At least an embedded locating flange 914 is set within the locating slot 913. The top of the hooked sheet 91 can swing to the left and right sides of the snowboard boot press surface 41 such that the locating column 92 is locked into the embedded locating flange 914 of the locating slot 913, helping to strengthen the positioning of the snowboard boot press surface 41 set on the rotary top pressboard 40. In this preferred embodiment, the bottom of the hooked sheet 91 can be further extended towards the back of the rear plate 20 to form a control arm 915. When the user intends to control the meshing or disengagement of the hooked sheet 91 and the locating column 92, the control arm 915 can be triggered upwards and downwards (indicated by arrow L9) for easier control.

Figure 10:
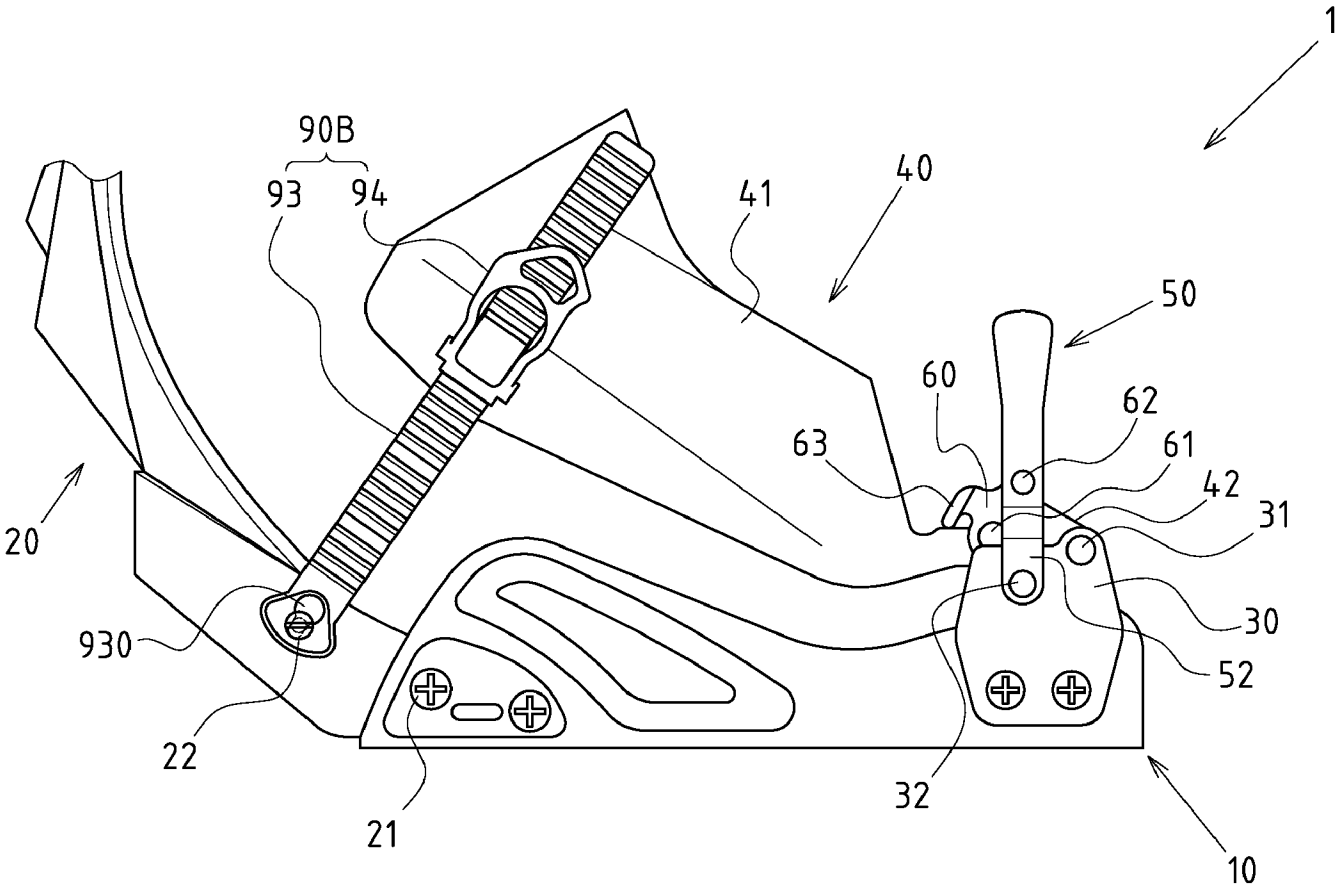
FIG. 10 shows another side elevation view of another preferred embodiment of the present invention, the snowboard binding being additionally provided with an auxiliary locator of top plate.
Figure 11:
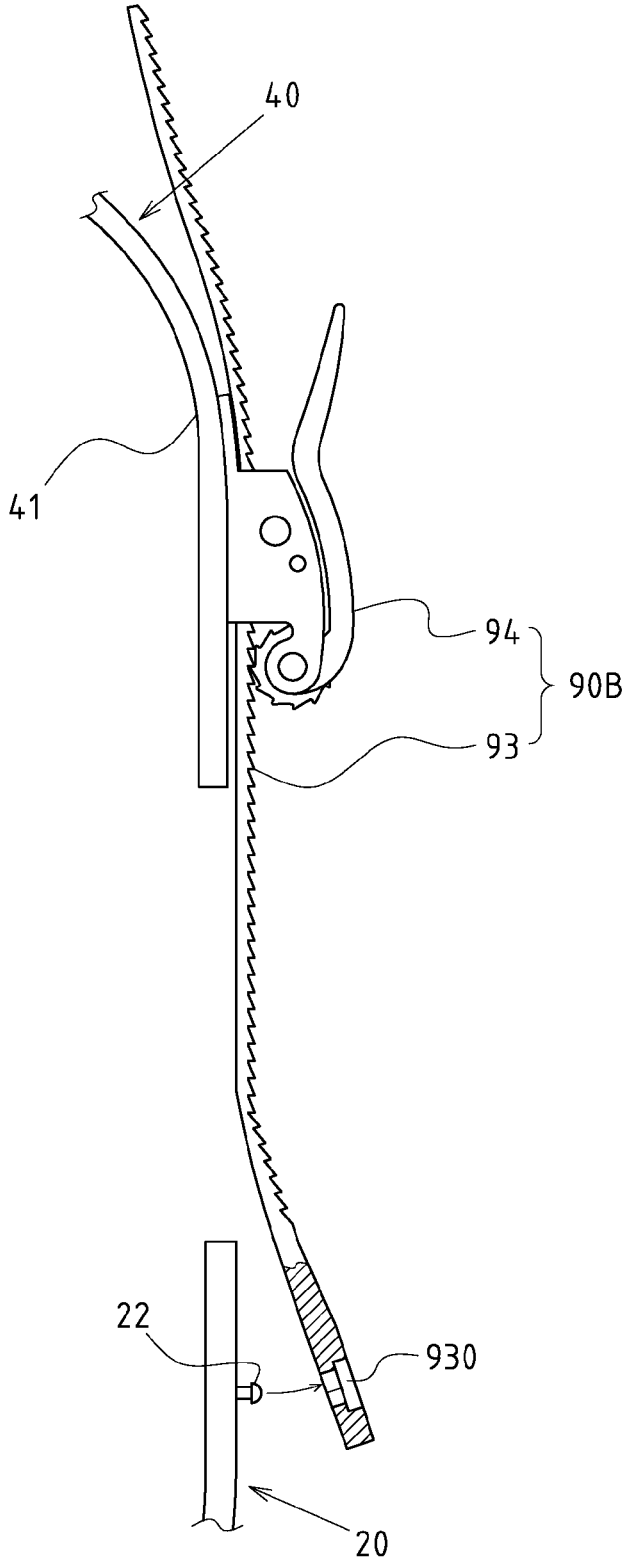
FIG. 11 shows a schematic view of the present invention, the sleeving hole set for the single-way ratchet bar disclosed in FIG. 10 being removed from the locating stud of the rear plate.

Referring also to FIGS. 10 and 11, the auxiliary locator of top plate 90B includes a single-way ratchet bar 93 and a control switch for locking release 94. The control switch for locking release 94 is assembled at left and right sides of the snowboard boot press surface 41 of the rotary top pressboard 40. A sleeving hole 930 is set at the bottom of the single-way ratchet bar 93. Said sleeving hole 930 is of a different internal diameter at both ends. A mushroom locating stud 22 is set close to bottom at the left and right sides of the rear plate 20, and used for locating of the sleeving hole 930 at the bottom of the single-way ratchet bar 93 (disclosed in FIG. 10) as well as for its easy removal (disclosed in FIG. 11). When the snowboard boot press surface 41 of the rotary top pressboard 40 is to swing forwards, the sleeving hole 930 at the bottom of the single-way ratchet bar 93 is removed from the locating stud 22, so that the single-way ratchet bar 93 can swing together with the snowboard boot press surface 41, without affecting the starting/movement of the rotary top pressboard 40. The control switch for locking release 94 mentioned herein is used to tighten and release the single-way ratchet bar 93 as in the prior art.

We claim:

1. A snowboard binding, comprising:

a mount, being comprised of a bottom plate and two lateral flanges protruding vertically at both sides of said bottom plate, said bottom plate having a snowboard locating portion set centrally thereon, a front opening formed in a front thereof, and a rear opening formed behind said bottom plate;

a rear plate extending vertically and having a bottom pivoted onto a rear side of said two lateral flanges of the mount;

two top plate assembly bases, mounted correspondingly at a front of said two lateral flanges of the mount, each top plate assembly base having a top plate joint and a trigger support joint assembled transversely at intervals on the top plate assembly base, said top plate joint being located higher than the trigger support joint;

a rotary top pressboard, being comprised of a snowboard boot press surface and two mating frames extending from both frontal sides of the snowboard boot press surface, the two mating frames being separately pivoted onto the top plate joint of two top plate assembly bases, the snowboard boot press surface of the rotary top pressboard being able to swing backwards into a pressing state, or forwards into an open state by taking the top plate joint as a pivot;

a trigger support, having a curved shape defining a trigger section and two mating ends at both ends of the trigger section, the two mating ends being separately pivoted onto the trigger support joint of the two top plate assembly bases, the trigger section swinging forwards or backwards by taking the trigger support joint as a pivot; and two coupling plates, coupled between the mating frames of the rotary top pressboard and the mating ends of the trigger support, each coupling plate being comprised of a first coupling end and a second coupling end, the first coupling end being pivoted onto the rotary top pressboard close to the mating frame, the second coupling end being pivoted onto the trigger support close to the mating end, each coupling plate, the mating frames of the rotary top pressboard, the mating ends of the trigger support and the top plate assembly base being coupled together to form a four-bar mechanism, wherein a swinging angle of the snowboard boot press surface of the rotary top pressboard exceeds 90° forming a super-wide-angle guide port of the snowboard boot, allowing to directly slip the snowboard boot downwards for loading purpose.

2. The snowboard binding defined in claim 1, further comprising:

a bossed claw being placed laterally onto the coupling plate and swinging upwards vertically in the trigger section of the trigger support, the snowboard boot press surface of the rotary top pressboard being abutted onto the mating frame of the rotary top pressboard when swinging backwards into a pressing state.

3. The snowboard binding defined in claim 1, wherein the snowboard locating portion on the bottom plate of the mount is comprised of a plurality of bolted locking holes arranged at intervals.

4. The snowboard binding defined in claim 1, wherein the snowboard locating portion on the bottom plate of the mount comprises a round hole on the bottom plate, a toothed ring surface surrounding the round hole, and a round locating disc with a toothed meshing surface on the bottom, the round locating disc being mated with the toothed ring surface via the toothed meshing surface in multiple angular positions, a plurality of bolted locating holes being arranged at intervals on the round locating disc.

5. The snowboard binding defined in claim 1, wherein the top plate assembly base is assembled onto the lateral flange of the mount to be lifted or regulated flexibly, the top plate assembly base being provided with a plurality of long holes arranged vertically, the lateral flange of the mount being provided with several groups of locating tapped holes extended and arranged transversely in alignment with the long holes, a plurality of bolts penetrating across the long holes and then locking into the locating tapped holes enabling the positioning of the top plate assembly base, the top plate assembly base being lifted or regulated before the bolt is screwed, the long holes of the top plate assembly base being locked correspondingly into the locating tapped holes on the lateral flange of the mount, enabling forward and backward adjustment of the top plate assembly base.

6. The snowboard binding defined in claim 5, wherein locating tooth surfaces are meshed, extended transversely and arranged between the top plate assembly base and the lateral flange of the mount, top plate assembly base having an orientation fixed accurately during lifting or regulation.

7. The snowboard binding defined in claim 1, further comprising:

an auxiliary locator of top plate, helping to strengthen the positioning of the snowboard boot press surface set on the rotary top pressboard.

8. The snowboard binding defined in claim 7, wherein the auxiliary locator of top plate comprises a swiveling hooked sheet and a locating column, said locating column being protruded transversely at left and right sides of the snowboard boot press surface on the rotary top pressboard, the bottom of the hooked sheet being pivoted adjacent to the bottom of the rear plate, a locating slot with opening being set at the top of the hooked sheet, at least an embedded locating flange being set within the locating slot, the top of the hooked sheet swinging to the left and right sides of the snowboard boot press surface such that the locating column is locked into the embedded locating flange of the locating slot, helping to strengthen the positioning of the snowboard boot press surface set on the rotary top pressboard.

9. The snowboard binding defined in claim 8, wherein the bottom of the hooked sheet further extends towards the back of the rear plate to form a control arm, thereby controlling the hooked sheet.

10. The snowboard binding defined in claim 7, wherein the auxiliary locator of top plate is further comprised of a single-way ratchet bar and a control switch for locking release, the control switch for locking release being assembled at left and right sides of the snowboard boot press surface of the rotary top pressboard, a sleeving hole being set at the bottom of the single-way ratchet bar, a locating stud being set close to bottom at the left and right sides of the rear plate, and used for locating of the sleeving hole at the bottom of the single-way ratchet bar, as well as for removal.

11. The snowboard binding defined in claim 1, wherein the bottom of the rear plate is pivoted onto the back of two lateral flanges of the mount via a pivot bolt, permitting the top of the rear plate to be adjusted in a swinging state.

* * * * *